US007327977B2

(12) United States Patent
Kitazawa et al.

(10) Patent No.: US 7,327,977 B2
(45) Date of Patent: Feb. 5, 2008

(54) IMAGE FORMING APPARATUS AND CORRECTION METHOD FOR COLOR REGISTRATION OFFSET

(75) Inventors: Koji Kitazawa, Nagano-ken (JP); Yujiro Nomura, Nagano-ken (JP); Ken Ikuma, Nagano-ken (JP); Kunihiro Kawada, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 25 days.

(21) Appl. No.: 11/285,507

(22) Filed: Nov. 22, 2005

(65) Prior Publication Data

US 2006/0120772 A1 Jun. 8, 2006

(30) Foreign Application Priority Data

Nov. 30, 2004 (JP) ..... 2004-345337
Dec. 2, 2004 (JP) ..... 2004-349544

(51) Int. Cl.
*G03G 15/01* (2006.01)

(52) U.S. Cl. ..... 399/301

(58) Field of Classification Search ..... 399/301
See application file for complete search history.

(56) References Cited

U.S. PATENT DOCUMENTS 5,778,280 A * 7/1998 Komiya et al. ..... 399/301
5,867,759 A * 2/1999 Isobe et al. ..... 399/301
2003/0214568 A1 11/2003 Nishikawa et al.
2004/0223785 A1 11/2004 Abe

FOREIGN PATENT DOCUMENTS

| | | |
|---|---|---|
| JP | 2000137367 | 5/2000 |
| JP | 2003098795 | 4/2003 |
| JP | 2003195604 | 7/2003 |
| JP | 2003207973 | 7/2003 |
| JP | 2004-109617 | 4/2004 |

OTHER PUBLICATIONS

Extended Search Report for European Patent Application No. 05025968.8-1240 lists references cited above.

* cited by examiner

*Primary Examiner*—David M. Gray
*Assistant Examiner*—Ruth N LaBombard
(74) *Attorney, Agent, or Firm*—Hogan & Hartson LLP

(57) ABSTRACT

Prior to the formation of registration pattern images (Step S7), base information is acquired by means of a test pattern sensor detecting a surface of an intermediate transfer belt or particularly a surface of a pattern formation region thereof. A surface condition of the pattern formation region is acquired based on the base information thus acquired, while the formation of the registration pattern images is controlled based on the surface condition. In this manner, the registration pattern images are formed with an adequate consideration given to the surface condition of the pattern formation region where the registration pattern images are to be formed (Step S7). Hence, the positions of the registration pattern images may be detected with high accuracies. As a result, a proper correction of color registration offset may be accomplished, assuredly preventing the occurrence of the color registration offset or degraded color tone.

6 Claims, 11 Drawing Sheets

IMAGE FORMING APPARATUS AND CORRECTION METHOD FOR COLOR REGISTRATION OFFSET

CROSS REFERENCE TO RELATED APPLICATION

The disclosure of Japanese Patent Applications enumerated below including specification, drawings and claims is incorporated herein by reference in its entirety:

No.2004-349544 filed Dec. 2, 2004; and

No.2004-345337 filed Nov. 30, 2004.

BACKGROUND OF THE INVENTION

1. Field of the Invention

The present invention relates to a color image forming apparatus of a so-called tandem system wherein a plurality of image forming stations individually forming toner images of different colors are arranged along a moving direction of a transfer medium. The invention further relates to a technique for correcting color registration offset.

2. Description of the Related Art

An apparatus set forth in Japanese Unexamined Patent Publication No.2004-109617, page 4, for example, has been known as this type of image forming apparatus. In this image forming apparatus, the image forming stations are arranged along the transfer medium, such as a transfer belt, on a per-color basis. The image forming station includes a charger, an image writing unit and a development unit which are disposed around a latent image carrier such as a photosensitive drum. Toner images formed by the individual image forming stations are mutually superimposed on the transfer medium, thereby forming a color image.

By the way, one of the serious problems encountered in the image forming apparatuses including a plurality of image forming stations is color registration offset. This problem results from mutual offset between/among transfer positions at which the individual toner images formed by the different image forming stations are transferred to the transfer medium. The color registration offset appears as a varied color tone. The following method is taken to solve this problem. Reference pattern images (hereinafter, referred to as "registration pattern images") for detection of color registration offset are previously formed on the transfer medium. On the other hand, positional information related to the registration pattern images is acquired by detecting the registration pattern images by means of optical sensors. Based on the positional information thus acquired, the individual toner images are registered to each other (correction of color registration offset).

SUMMARY OF THE INVENTION

The optical sensor for detecting the registration pattern image formed on the transfer medium includes a photoemitter and a photodetector. The sensor irradiates light on the registration pattern image on the transfer medium by means of the photoemitter, while receiving light reflected from the registration pattern image by means of the photodetector. The optical sensor outputs a signal corresponding to a quantity of light received by the photodetector, so that the registration pattern image is detected based on the output signal. It is therefore important to consider a surface condition or a base condition of the transfer medium. If the transfer medium sustains contamination at a surface region of its surface, where the registration pattern image is formed, the quantity of light received by the photodetector is significantly deviated so that the detection of the position of the registration pattern image is significantly lowered in accuracy. In the conventional apparatuses, however, the correction of color registration offset has been performed without giving adequate consideration to the surface condition (base condition) of the transfer medium. Hence, as the surface of the transfer medium becomes more and more contaminated with increase in the cumulative operation time of the apparatus, the positions of the registration pattern images are detected with low accuracies. As a result, the apparatus is incapable of accomplishing a favorable correction of color registration offset. This leads to a problem that the apparatus produces prints out of color registration or fails to provide a desired color tone.

A primary object of the invention is to provide an image forming apparatus adapted to prevent the occurrence of color registration offset or color tone degradation by performing the formation of registration pattern images while considering the surface condition of the transfer medium, as well as to provide a correction method for color registration offset.

According to a first aspect of the present invention, there is provided an image forming apparatus wherein a plurality of image forming stations are arranged along a moving direction of a transfer medium and form toner images having different colors each other, an optical sensor detects the toner images which are formed as registration patterns on a pattern formation region of a surface of the transfer medium at space intervals along the moving direction and outputs a signal, and correction of color registration offset is performed by correcting the registration offset between/among the plural colors based on the output signal from the optical sensor which detects the registration pattern images, the apparatus comprising: a surface condition acquisition unit which acquires a surface condition of the transfer medium based on base information acquired by detecting the surface of the transfer medium by means of the optical sensor prior to the formation of the registration pattern images; and a pattern formation control unit which controls the formation of the registration pattern images based on the surface condition of the transfer medium acquired by the surface condition acquisition unit.

According to a second aspect of the present invention, there is provided a method of correcting a registration offset generating in an apparatus wherein a plurality of image forming stations are arranged along a moving direction of a transfer medium and form toner images having different colors each other, the method comprising: a pattern formation step of forming, as registration pattern images, the toner images by means of the plural image forming stations, the registration pattern images being arranged on a pattern formation region of the transfer medium at space intervals along the moving direction; a pattern detection step of detecting the registration pattern images for acquiring positional information pieces with respect to the registration pattern images; a correction step of correcting the registration offset between/among the plural colors based on the positional information pieces acquired by the pattern detection step; a surface condition acquisition step of acquiring a surface condition of the transfer medium based on base information acquired by detecting a surface of the transfer medium by means of an optical sensor prior to the pattern formation step; and a pattern formation control step of controlling the registration-pattern formation step based on the surface condition of the transfer medium acquired by the surface condition acquisition step.

According to a third aspect of the present invention, there is provided an image forming apparatus wherein a plurality of image forming stations are arranged along a moving direction of a transfer medium and form toner images having different colors each other, an optical sensor detects the toner images which are formed as registration patterns on a surface of the transfer medium at space intervals along the moving direction and outputs a signal, and correction of color registration offset is performed by correcting the registration offset between/among the plural colors based on the output signal from the optical sensor which detects the registration pattern images, the apparatus comprising: a surface condition acquisition unit which acquires a surface condition of the transfer medium based on base information acquired by the optical sensor detecting a surface segment of the transfer medium, the surface segment being located between two adjoining registration pattern images; and a correction control unit which controls the correction of color registration offset based on the surface condition of the transfer medium acquired by the surface condition acquisition unit.

According to a forth aspect of the present invention, there is provided a method of correcting a registration offset generating in an apparatus wherein a plurality of image forming stations are arranged along a moving direction of a transfer medium and form toner images having different colors each other, the method comprising: a pattern formation step of forming, as registration pattern images, the toner images by means of the plural image forming stations, the registration pattern images arranged on the transfer medium at space intervals along the moving direction; a pattern detection step of detecting the registration pattern images for acquiring positional information pieces with respect to the registration pattern images; a correction step of correcting the registration offset between/among the plural colors based on the positional information pieces acquired by the pattern detection step; a surface condition acquisition step of acquiring a surface condition of the transfer medium based on base information acquired by an optical sensor detecting a surface segment of the transfer medium, which is located between two adjoining registration pattern images; and a correction control step of controlling the correction of color registration offset based on the surface condition of the transfer medium acquired by the surface condition acquisition step.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DETAILED DESCRIPTION OF THE PREFERRED EMBODIMENTS

First Embodiment

Figure 1:
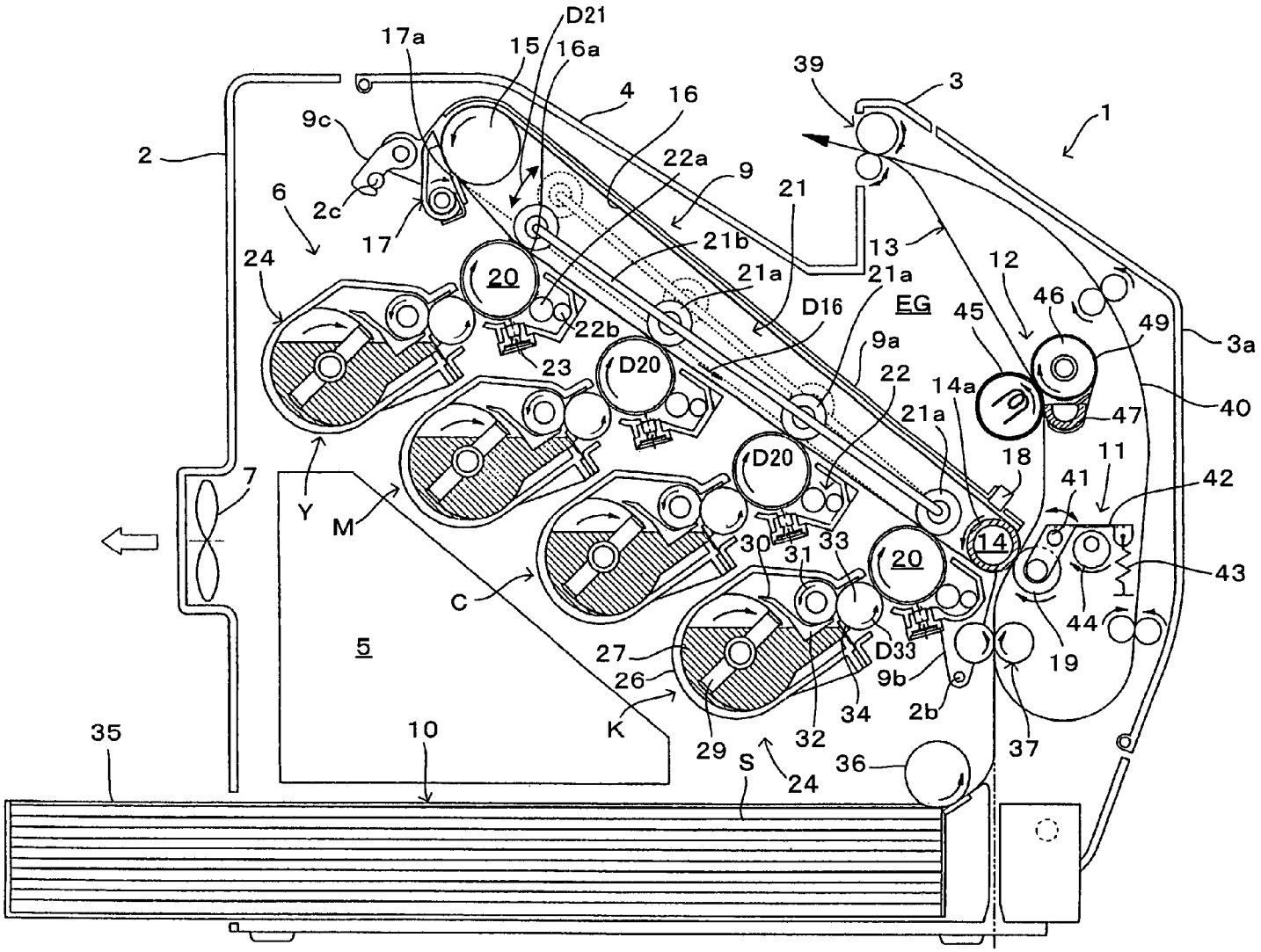
FIG. 1 is a sectional view showing an image forming apparatus according to one embodiment of the invention.
Figure 2:
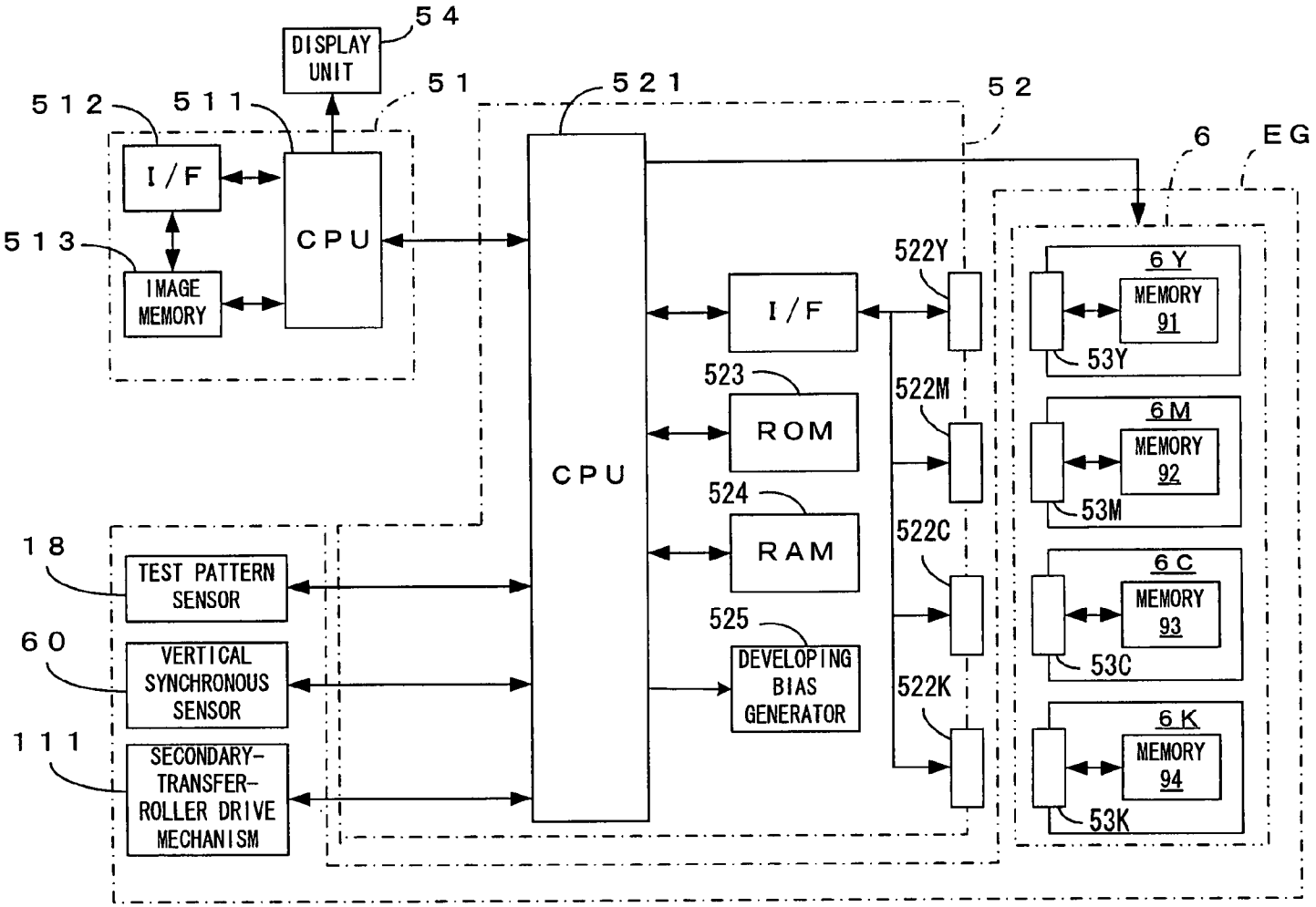
FIG. 2 is a block diagram showing an electrical arrangement of the image forming apparatus of FIG. 1.

FIG. 1 is a sectional view showing an image forming apparatus according to one embodiment of the invention. FIG. 2 is a block diagram showing an electrical arrangement of the image forming apparatus of FIG. 1. The apparatus 1 is an image forming apparatus designed to selectively perform a color print process for forming a full-color image by superimposing four color toners (developers) including black (K), cyan (C), magenta (M) and yellow (Y), or a monochromatic print process for forming a monochromatic image using the black (K) toner alone. The image forming apparatus 1 operates as follows. When an external apparatus such as a host computer applies an image formation command (print command) to a main controller 51, the main controller 51 applies a command, based on which an engine controller 52 controls individual parts of an engine EG for effecting a predetermined image forming operation, thereby forming an image corresponding to the image formation command on a sheet (recording material) S such as copy sheet, transfer sheet, paper and transparent sheet for OHP.

Referring to FIG. 1, the image forming apparatus 1 of the embodiment includes: a housing body 2; a first closing member 3 attached to place on a front side (the right lateral side as seen in the figure) of the housing body 2 in an openable manner; and a second closing member 4 (also serving as a sheet discharge tray) attached to place on an upper side of the housing body 2 in an openable manner. The first closing member 3 includes a closing cover 3*a* attached to place on the front side of the housing body 2 in an openable manner. The closing cover 3*a* is adapted to be opened or closed in operative association with the first closing member 3 or independently therefrom.

Disposed in the housing body 2 is an electric component box 5 incorporating a power source circuit board, the main controller 51 and the engine controller 52. Furthermore, an image forming unit 6, a fan 7, a transfer belt unit 9 and a sheet feeder unit 10 are also disposed in the housing body 2. On the other hand, a secondary transfer unit 11, a fixing unit 12 and a sheet transport mechanism 13 are disposed in the neighborhood of the first closing member 3. In this embodiment, consumable articles for use in the image forming unit 6 and the sheet feeder unit 10 are so designed as to be free to be mounted in or dismounted from an apparatus body. Furthermore, these consumable articles and the transfer belt unit 9 are each designed to be dismountable for repair or replacement.

The transfer belt unit 9 includes: a drive roller 14 disposed at a lower place in the housing body 2 and driven into rotation by an unillustrated drive motor; a driven roller 15 disposed at place diagonally upwardly from the drive roller 14; an intermediate transfer belt 16 stretched between these two rollers 14, 15 for drivable cycling motion in a direction indicated by an arrow D16 in the figure; and a cleaner 17 abutted against a surface of the intermediate transfer belt 16. The driven roller 15 is located diagonally upwardly (diagonally upward left as seen in FIG. 1) relative to the drive roller 14. Hence, the intermediate transfer belt 16 is rotationally moved in the direction D16 as held in a slant position. A belt surface 16*a* of the intermediate transfer belt 16 is located on the lower side thereof, the belt surface 16*a* in downward movement (right downward movement as seen in FIG. 1) in the belt-transport direction D16 when the intermediate transfer belt 16 is driven. According to the embodiment, the belt surface 16*a* defines a tension side of the belt being driven (the side tensioned by the drive roller 14) and has a higher circumferential velocity V16 (say, 1.03×V20) than a circumferential velocity V20 of a latent image carrier 20 for each color, which will be described hereinlater. The circumferential velocity V16 of the intermediate transfer belt 16 is set higher than the circumferential velocity V20 of each latent image carrier 20, such that the intermediate transfer belt 16 may pullingly drive each latent image carrier 20.

The drive roller 14 and the driven roller 15 are rotatably supported by a support frame 9*a*. The support frame 9*a* is formed with a pivotal portion 9*b* at a lower end thereof, whereas the pivotal portion is fitted with a pivot shaft 2*b* (pivot point) provided at the housing body 2. Thus, the support frame 9*a* is free to pivot relative to the housing body 2. On the other hand, a lock lever 9*c* is pivotally disposed at an upper end of the support frame 9*a* for locking engagement with a lock shaft 2*c* disposed at the housing body 2.

The drive roller 14 also serves as a backup roller for a secondary transfer roller 19 constituting the secondary transfer unit 11. As shown in FIG. 1, the drive roller 14 is formed with a rubber layer 14*a* on its periphery, the rubber layer having a thickness on the order of 3 mm and a volume resistivity of $10^5$ Ω·cm or less. The drive roller 14 is grounded via a metallic shaft thereof, thus serving as a conductive path of a secondary transfer bias which is supplied from an unillustrated secondary transfer bias generator via the secondary transfer roller 19. In this manner, the rubber layer 14*a* having high friction and impact absorption is formed on the drive roller 14, thereby reducing impact transmitted to the intermediate transfer belt 16, the impact caused by the sheet S entering a secondary transfer area. Thus is prevented the degradation of image quality.

According to the embodiment, the drive roller 14 has a smaller diameter than that of the driven roller 15. This permits the sheet S after secondary image transfer to be readily separated from the belt by its own elastic force. The driven roller 15 is designed to also serve as a backup roller for the cleaner 17. The cleaner 17 is disposed adjacent to the belt surface 16*a* moved in the downward transport direction. As shown in FIG. 1, the cleaner 17 includes: a cleaning blade 17*a* for removing residual toner; and toner transport member for transporting the removed toner. The cleaning blade 17*a* is abutted against the intermediate transfer belt 16 at its portion engaged with the driven roller 15 for cleaning off the residual toner from the intermediate transfer belt 16 after secondary image transfer.

Disposed on a back side of the downward-moving belt surface 16*a* of the intermediate transfer belt 16 is a primary transfer unit 21 which includes primary transfer rollers 21*a* individually opposing the respective latent image carriers 20 of the image forming stations Y, M, C, K to be described hereinlater. In the primary transfer unit 21, the four primary transfer rollers 21*a* are rotatably carried by a link bar 21*b*. These primary transfer rollers 21*a* are electrically connected to an unillustrated primary transfer bias generator such that the primary transfer bias generator may apply a primary transfer bias to any of the primary transfer rollers in a proper timing.

The link bar 21*b* is free to pivot in directions of arrows D21 about the primary transfer roller 21*a* opposite the latent image carrier 20 of the black(K) image forming station K. The link bar 21*b* is pivotally moved by operating an unillustrated actuator, whereby the primary transfer rollers 21*a* disposed in opposing relation with the respective latent image carriers 20 of the yellow(Y), magenta(M) and cyan (C) image forming stations Y, M, C are moved toward or away from the latent image carriers 20. Hence, the individual primary transfer rollers 21*a* moved toward the latent image carriers 20 are brought into abutment against the respective latent image carriers 20 via the intermediate transfer belt 16 (indicated by a solid line in FIG. 1). The abutment positions define primary transfer positions, where the respective toner images are transferred to the intermediate transfer belt 16, as will be described hereinlater. Conversely, when the individual primary transfer rollers 21*a* are moved away from the respective latent image carriers 20, the respective latent image carriers 20 of the image forming stations Y, M, C are spaced away from the intermediate transfer belt 16 (indicated by a broken line in FIG. 1). On the other hand, the primary transfer roller 21*a* disposed opposite the latent image carrier 20 of the black(K) image forming station K is designed to rotate as abutted against the latent image carrier 20 via the intermediate transfer belt 16. As indicated by the solid line in FIG. 1, therefore, the color print process is enabled by moving all the primary transfer rollers 21*a* toward the respective latent image carriers 20. As indicated by the broken line in the figure, on the other hand, the other primary transfer rollers 21*a* than the primary transfer roller 21*a* for black are moved away from the respective latent image carriers 20, whereby the monochromatic print process may be exclusively performed with the image forming stations Y, M, C placed in a non-printing state.

The support frame 9*a* of the transfer belt unit 9 is provided with a test pattern sensor 18 adjacent to the drive roller 14. The test pattern sensor 18 is an optical sensor of a so-called reflective type, and includes a photoemitter (not shown) for emitting light toward the surface of the intermediate transfer belt 16, and a photodetector (not shown) for receiving light reflected from the surface of the intermediate transfer belt 16 or from a registration pattern image to be described hereinlater. The photoemitter irradiates the light on the registration pattern image on the transfer medium, whereas the light reflected from the registration pattern image is received by the photodetector. A signal corresponding to a quantity of light received by the photodetector is outputted from the test pattern sensor 18. Based on the output signal from the test pattern sensor 18, each colored toner image is positioned on the intermediate transfer belt 16 while a density of each colored toner image is detected. Then, correction is made for registration offset among the colored images or for image density. According to this embodiment, a vertical synchronous sensor 60 (FIG. 2) besides the above sensor 18 is mounted to the support frame 9*a* for detection of a feature portion of the intermediate transfer belt 16 (such as a projection projecting from the belt in a widthwise direction thereof). Hence, a vertical synchronous signal (reference signal) is outputted from the sensor 60 each time the feature portion of the intermediate transfer belt 16 passes the sensor 60.

The image forming unit 6 includes the plural (four in this embodiment) image forming stations Y(yellow), M(magenta), C(cyan) and K(black) for forming images of four different colors. Each of the image forming stations Y, M, C, K is provided with the latent image carrier 20 comprising a photosensitive drum. Disposed around each latent image carrier 20 are a charger 22, an image writing unit 23 and a development unit 24. A charging operation, a latent-image forming operation and a toner development operation are carried out by these function units, respectively. In the figure, only the development unit 24 of the image forming station K is represented by the reference character. The development units of the other image forming stations have the same construction and hence, the reference characters thereof are omitted. The image forming stations Y, M, C, K may be arranged in any order.

The respective latent image carriers 20 of the image forming stations Y, M, C, K are brought into abutment against the downward-moving belt surface 16*a* of the intermediate transfer belt 16 at the primary transfer positions. As a result, the image forming stations Y, M, C, K are also arranged in a diagonally leftward direction relative to the drive roller 14. As indicated by arrows D20 in the figure, the individual latent image carriers 20 are driven into rotation at the predetermined circumferential velocity V20 in the transport direction of the intermediate transfer belt 16. In this embodiment, a circumferential length of the latent image carrier 20 with respect to the rotational direction D20 thereof is smaller than a length of a sheet of the minimum size, such as a post card.

The charger 22 includes a charger roller 22*a*, a surface of which is formed from an elastic rubber. The charger roller 22*a* is designed to be abutted against a surface of the latent image carrier 20 at a charging position so as to be driven into rotation. In conjunction with the rotation of the latent image carrier 20, the charger roller followingly rotates at a circumferential velocity V22*a*(=V20) in a driven direction relative to the latent image carrier 20. The charger roller 22*a* is connected to a charging bias generator (not shown) so as to be supplied with a charging bias from the charging bias generator for charging the surface of the latent image carrier 20 at the charging position. In this embodiment, the charger 22 further includes a cleaning roller 22*b* as a component thereof.

The image writing unit 23 employs an array-type writing head wherein devices such as liquid crystal shutters each including a light emitting diode or a backlight are arranged in an array along an axial direction of the latent image carrier 20. The image writing unit is spaced from the latent image carrier 20. The array-type writing head has the following advantages. That is, the writing head features compactness with a shorter light path than that of a laser scanning optical system and may be disposed in close adjacency to the latent image carrier 20. Hence the array-type writing head contributes to the downsizing of the whole body of the apparatus. This embodiment is arranged as follows. The latent image carrier 20, the charger 22 and the image writing unit 23 of each of the image forming stations Y, M, C, K are unified as a replaceable cartridge 6Y, 6M, 6C, 6K (FIG. 2) such as to retain the array-type writing head at position. When the replaceable cartridge is replaced, the cartridge containing the array-type writing head is dismounted. The writing head is adjusted for light intensity and positioned with respect to a fresh replaceable cartridge before the writing head is put to reuse. The replaceable cartridges 6Y, 6M, 6C, 6K are individually provided with non-volatile memories 91 to 94 for storing information on the corresponding replaceable cartridges. Transmission/reception portions 53Y, 53M, 53C, 53K disposed at the replaceable cartridges are located in close adjacency to transmission/reception portions 522Y, 522M, 522C, 522K disposed on the apparatus body side, respectively, so that wireless communications may be carried out between a CPU 521 of the engine controller 52 and the respective memories 91 to 94. Thus, the information on the respective replaceable cartridges is transmitted to the CPU 521, while the information in the respective memories 91 to 94 is updated and stored.

Next, the details of the development unit 24 will be described by way of typical example of the image forming station K. In the embodiment, a toner reservoir 26 of each image forming station is disposed as inclined diagonally downwardly because the image forming stations Y, M, C, K are disposed in a diagonal direction and have their latent image carriers 20 abutted against the downward-moving belt surface 16*a* of the intermediate transfer belt 16 with respect to the transport direction. Therefore, the development unit 24 adopts a special constitution. Specifically, the development unit 24 includes: the toner reservoir 26 for storing the toner (represented by a hatched area in FIG. 1); a toner storing portion 27 defined in the toner reservoir 26; a toner stirring member 29 disposed in the toner storing portion 27; a partitioning member 30 defined in an upper part of the toner storing portion 27; a toner feeding roller 31 disposed above the partitioning member 30; a blade 32 disposed at the partitioning member 30 and abutted against the toner feeding roller 31; a developing roller 33 rotated at a circumferential velocity V33 as abutted against the toner feeding roller 31 and the latent image carrier 20; and a regulating blade 34 abutted against the developing roller 33.

The latent image carrier 20 is rotated in the transport direction D16 of the intermediate transfer belt 16. As indicated by an arrow D33 in the figure, the developing roller 33 and the feeding roller 31 are driven into rotation in the opposite direction to the rotational direction D20 of the latent image carrier 20. On the other hand, the stirring member 29 is driven into rotation in the opposite direction to the rotational direction of the feeding roller 31. In the toner storing portion 27, therefore, the toner stirringly lifted up by the stirring member 29 is fed by the toner feeding roller 31 along an upper side of the partitioning member 30. The toner fed in this manner is rubbed against the blade 32 so as to be applied to a surface of the developing roller 33 by way of a mechanical adhesive force to a rough surface of the feeding roller 31 and an adhesive force associated with triboelectricity. The toner applied to the developing roller 33 is limited to a predetermined layer thickness by means of the regulating blade 34. The resultant thin toner layer is transported to the latent image carrier 20. At a development position at which the developing roller 33 abuts against the latent image carrier 20, the normally charged toner is transferred from the developing roller 33 to the latent image carrier 20 by way of a developing bias applied from a developing bias generator 525 to the developing roller 33, the developing bias generator electrically connected to the developing roller 33. Thus is visualized the electrostatic latent image formed by the image writing unit 23.

According to the embodiment, a so-called development/cleaning concurrent process is performed in which the development using the toner is performed in the aforementioned manner while the residual toner on the latent image carrier 20 is collected by the developing roller 33. In this manner, a cleaner-less system for collecting the toner remaining on the surface of the latent image carrier after primary image transfer is constituted at the development position.

The sheet feeder unit 10 includes a sheet feeding portion including: a sheet cassette 35 retaining a stack of sheets S; and a pick-up roller 36 for feeding the sheets S one by one from the sheet cassette 35. In the first closing member 3, there are disposed a registration roller pair 37 for regulating timing of feeding the sheet S to a secondary transfer area; the secondary transfer unit 11 as secondary transfer means pressed against the drive roller 14 and the intermediate transfer belt 16; the fixing unit 12; the sheet transport mechanism 13; a sheet discharge roller pair 39; and a transport path for double-side printing 40.

The secondary transfer unit 11 includes: the secondary transfer roller 19 free to be moved away from or brought into contact against the intermediate transfer belt 16; and a secondary-transfer-roller drive mechanism 111 for driving the secondary transfer roller 19 away from or into contact against the intermediate transfer belt 16. In the secondary-transfer-roller drive mechanism 111, a pivot lever 42 is pivotally carried on a fixing shaft 41, the pivot lever having the secondary transfer roller 19 rotatably mounted to one end thereof. A spring 43 is disposed between the other end of the pivot lever 42 and the first closing member 3, such that a biasing force of the spring may move the secondary transfer roller 19 in a directions of an arrow in the figure so as to press the secondary transfer roller 19 against the intermediate transfer belt 16 and the drive roller 14. The secondary-transfer-roller drive mechanism 111 further includes an eccentric cam 44, which is disposed at place adjacent to the spring 43 of the pivot lever 42. The eccentric cam 44 is rotated by a driving force of a drive motor via an unillustrated clutch, thereby pivotally moving the pivot lever 42 against the spring 43 for moving the secondary transfer roller 19 away from the intermediate transfer belt 16.

The fixing unit 12 includes: a rotatable heating roller 45 incorporating therein a heating element such as a halogen heater; a pressure roller 46 for pressingly urging the heating roller 45; a belt tensioning member 47 pivotally mounted to the pressure roller 46; and a heat-resistant belt 49 stretched between the pressure roller 46 and the belt tensioning member 47. At a nip portion defined by the heating roller 45 and the heat-resistant belt 49, an image secondarily transferred to the sheet S is fixed to the sheet S at a predetermined temperature. The embodiment allows the fixing unit 12 to be disposed in space defined diagonally upwardly from the intermediate transfer belt 16 or, in other words, in the space on the opposite side from the image forming unit 6 with respect to the intermediate transfer belt 16. Hence, the embodiment is adapted to reduce heat transferred to the electric component box 5, image forming unit 6 and intermediate transfer belt 16, so that the frequency of performing a correction of color registration offset for each color may be reduced.

The sheet S thus subjected to the fixing process is transported through the sheet discharge roller pair 39 to the second closing member (sheet discharge tray) 4 disposed at the upper side of the apparatus body. In a case where images are formed on the both sides of the sheet S, the rotation of the sheet discharge roller pair 39 is reversed at the time when a trailing end of the sheet S with the image formed on one side thereof arrives at a reversal position rearward of the sheet discharge roller pair 39, whereby the sheet S is transported along a transport path for double-side printing 40. Subsequently, the sheet S is loaded again on the transport path at place upstream from the registration roller pair 37. At this time, the sheet S is positioned in a manner that the opposite side from that to which the image was previously transferred is to be pressed against the intermediate transfer belt 16 in a secondary transfer region for image transfer. The images may be formed on the both sides of the sheet S in this manner.

As shown in FIG. 2, the apparatus 1 includes a display unit 54 controlled by a CPU 511 of the main controller 51. The display unit 54 comprises, for example, a liquid crystal display. According to a control command from the CPU 511, the display unit shows a predetermined message indicative of operation guidance for a user, progress in the image forming operation, abnormality in the apparatus, replacement time of any of the units or the like.

Figure 3:
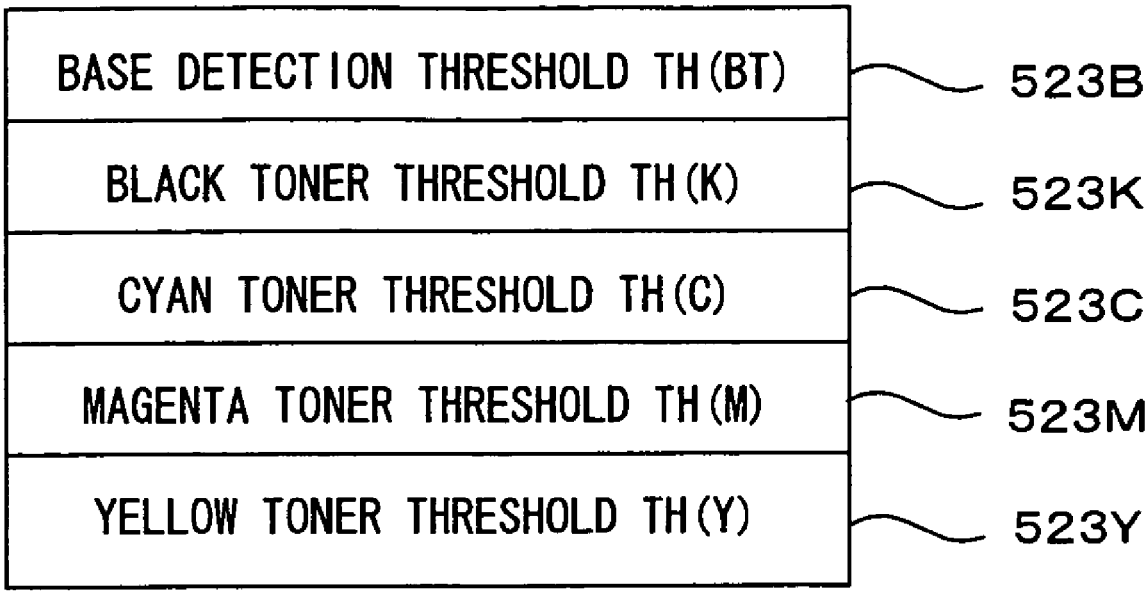
FIG. 3 is a diagram showing a part of the memory space of the ROM mounted in the apparatus of FIG. 1.

In FIG. 2, indicated at 513 is an image memory disposed in the main controller 51 for storing an image supplied from the external apparatus, such as the host computer, via an interface 512. Indicated at 523 is a ROM for storing an operation program executed by the CPU 521 and control data used for controlling the engine EG. Indicated at 524 is a RAM for temporarily storing operation results given by the CPU 521 and other data. FIG. 3 is a diagram showing a part of the memory space of the ROM mounted in the apparatus of FIG. 1. According to the embodiment, in particular, memory space segments 523Y, 523M, 523C, 523K are defined in the ROM 523 for storing respective pattern-detection threshold information pieces, based on which the test pattern sensor 18 detects registration pattern images of the individual colors for acquiring positional information on the registration pattern images, which positional information is used in the correction of color registration offset. The correction of color registration offset will be described hereinlater. A yellow toner threshold TH(Y), a magenta toner threshold TH(M), a cyan toner threshold TH(C) and a black toner threshold TH(K), as the pattern-detection threshold information, are previously stored in the respective memory space segments 523Y, 523M, 523C, 523K. Furthermore, a memory space segment 523B is defined in the ROM 523 for storing base-detection threshold information, based on which the test pattern sensor 18 detects a surface condition of the intermediate transfer belt 16. A base detection threshold TH(BT), as the base-detection threshold information, is previously stored in the memory space segment 523B. Specifically, the base detection threshold TH(BT) is a reference value, based on which determination is made as to whether or not the intermediate transfer belt 16 has its surface condition in a proper range without suffering surface contamination or damage. That is, the ROM 523 according to the embodiment functions as a "memory for base detection" and a "memory for pattern detection" of the invention.

Figure 4:
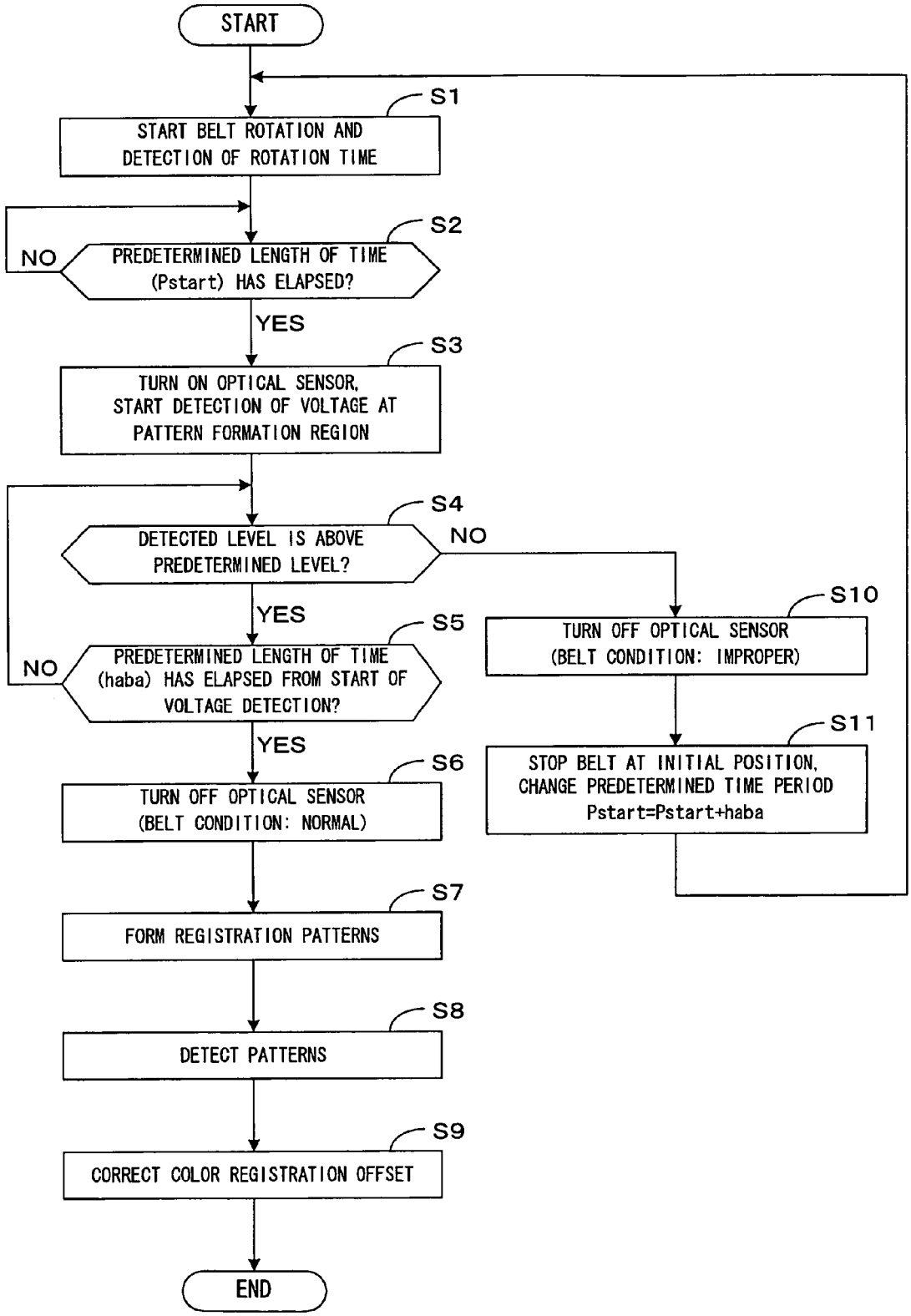
FIG. 4 is a flow chart showing operations of the image forming apparatus of FIG. 1.
Figure 5:
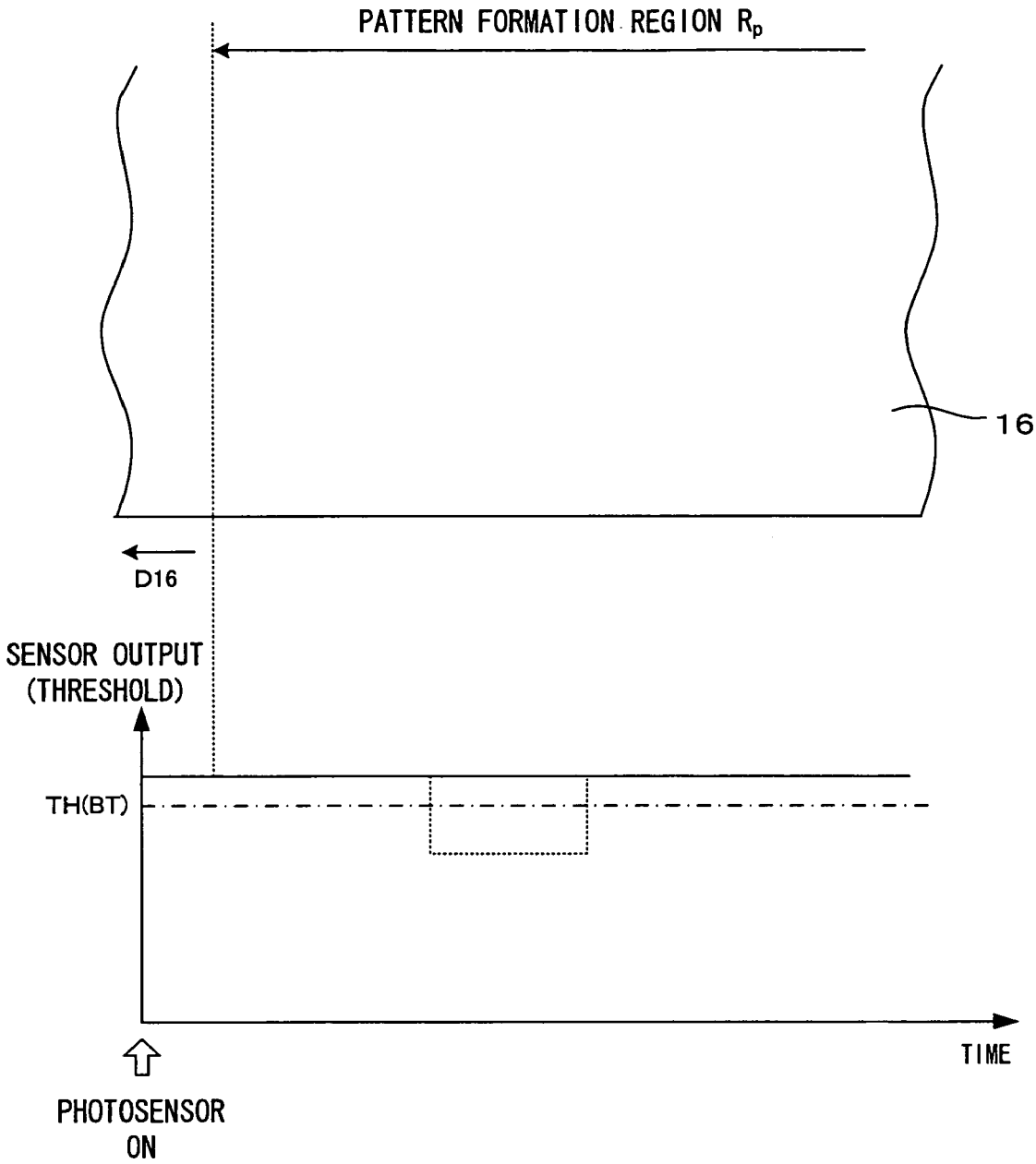
FIG. 5 is a schematic diagram showing the operation of acquiring the surface condition of the intermediate transfer belt 16.
Figure 6:
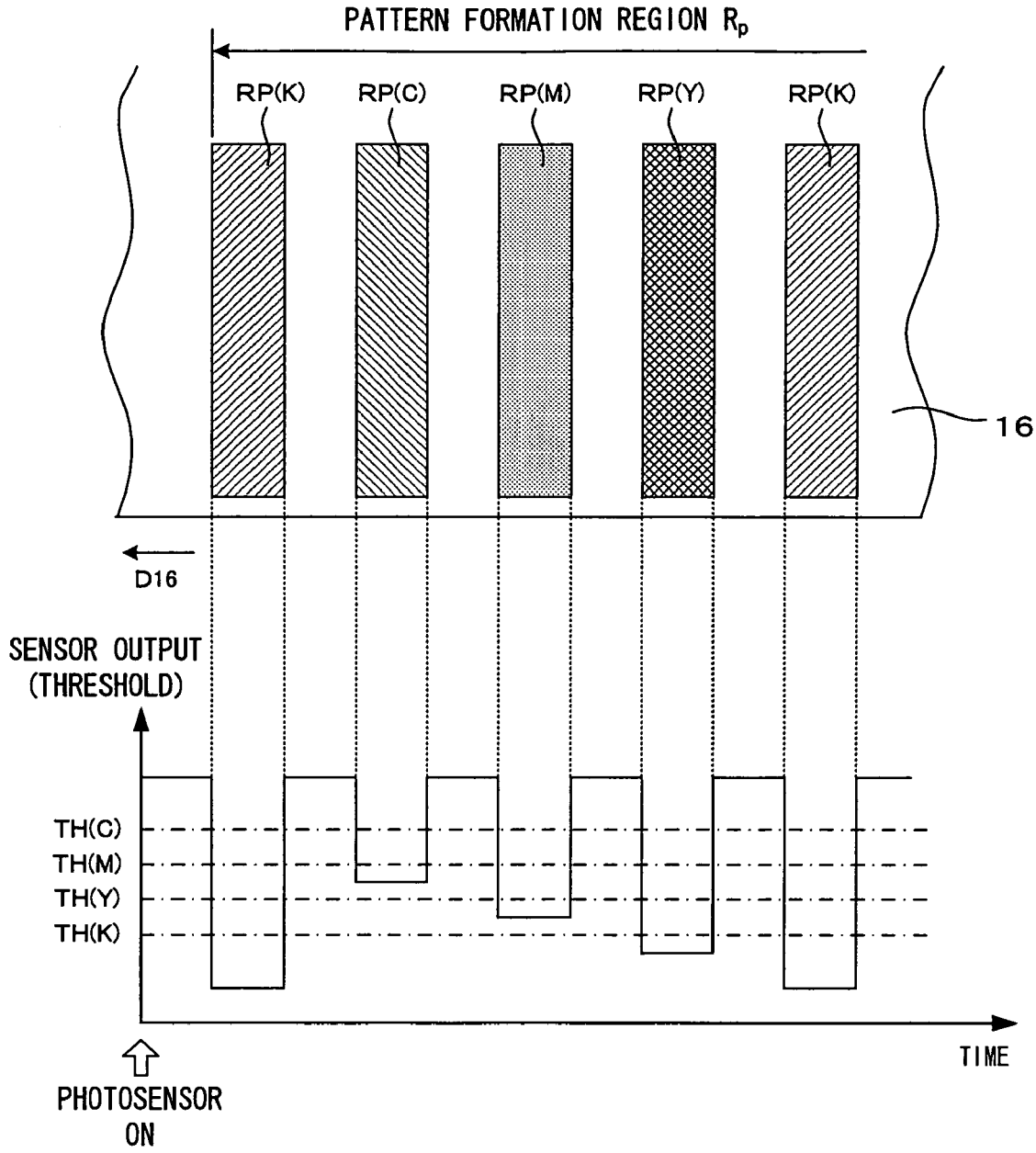
FIG. 6 is a schematic diagram showing the pattern detection operation for the correction of color registration offset.

FIG. 4 is a flow chart showing operations of the image forming apparatus of FIG. 1. The chart illustrates acquisition of the surface condition of the intermediate transfer belt 16, formation/detection of the registration pattern images and correction of color registration offset. FIG. 5 is a schematic diagram showing the operation of acquiring the surface condition of the intermediate transfer belt 16. FIG. 6 is a schematic diagram showing the pattern detection operation for the correction of color registration offset. In this apparatus, the correction of color registration offset using the registration pattern images is performed at a proper time such as when the apparatus is turned on or when the cartridge is replaced. More specifically, the CPU 521 of the engine controller 52 functions as a "surface condition acquisition unit" and a "pattern formation control unit" of the invention according to a program related to the correction of color registration offset and stored in the ROM 523. The CPU 521 controls the individual parts of the apparatus in the following manner for executing the acquisition of the surface condition of the intermediate transfer belt, the formation/detection of the registration pattern images and the correction of color registration offset. With reference to FIG. 4 to FIG. 6, the acquisition of the surface condition of the intermediate transfer belt 16, the formation/detection of the registration pattern images and the correction of color registration offset will be described as below.

Prior to the formation/detection of the registration pattern images and the correction of color registration offset, Steps S1 to S6 are performed to acquire the surface condition of the intermediate transfer belt 16 (surface condition acquisition step). Specifically, the drive motor (not shown) starts rotating the drive roller 14 in step S1 for driving the intermediate transfer belt 16 into cycling motion in the direction of the arrow D16. In the meantime, detection is started to determine a rotation time of the intermediate transfer belt 16 from the start of rotation thereof, so as to calculate a moving distance of the intermediate transfer belt 16. In Step S2, the CPU 52 waits for a head position of a pattern formation region $R_p$ to arrive at the test pattern sensor (optical sensor) 18 when a predetermined length (Pstart) of moving time of the intermediate transfer belt 16 has elapsed. At this point of time, the photoemitter (not shown) of the test pattern sensor 18 is activated to start the detection of the surface condition of the intermediate transfer belt 16 by means of the test pattern sensor 18 (Step S3).

The pattern formation region $R_p$ passes by the test pattern sensor 18 in conjunction with the movement of the intermediate transfer belt 16 in the transport direction D16, while the light reflected from the pattern formation region $R_p$ is received by the photodetector (not shown) of the test pattern sensor 18. A voltage level of a signal outputted from the test pattern sensor 18 fluctuates according to a quantity of received light. Hence, a surface condition of the pattern formation region $R_p$ may be acquired as the base information by detecting the voltage level. More specifically, the embodiment takes the following procedure. The base detection threshold TH(BT) is retrieved from the memory space segment 523B of the ROM 523 and is set as the base-detection threshold information. It is verified that the surface condition of the pattern formation region $R_p$ falls within the proper range by determining the detected voltage level to be above a predetermined level or the base detection threshold TH(BT), as indicated by a solid line in FIG. 5 (Step S4).

Such a verification process is continued for a predetermined length of time (haba) from the start of detection of the voltage level (Step S3) (Step S5). The "predetermined time period (haba)" corresponds to a length of the pattern formation region $R_p$ with respect to the transport direction (moving direction) D16. Hence, whether the overall surface of the pattern formation region $R_p$ is in a normal condition or not may be determined by continuing the detection/verification of the voltage level for the time period (haba). After completion of the verification of the surface condition, the photodetector of the test pattern sensor 18 is turned off in Step S6 and the acquisition of the surface condition of the intermediate transfer belt 16 is completed.

When it is thus verified that the overall surface of the pattern formation region $R_p$ is in the proper condition, the image forming stations Y, M, C, K individually form the registration pattern images according to the control command from the CPU 521 of the engine controller 52. Then, the registration pattern images are formed on the pattern formation region $R_p$ of the intermediate transfer belt 16 (Step S7) (pattern formation step, pattern formation control step). It is noted here that the shape, dimensions, spacing, arrangement and number of the registration pattern images are optional and a large number of various modes have conventionally been proposed. According to the embodiment, as shown in FIG. 6 for example, the registration pattern images having a band-like shape (0.5 mm in width, for example) and extending in parallel to a direction (main scan direction) orthogonal to the transport direction D16 of the intermediate transfer belt 16 are formed on a part of the surface of the intermediate transfer belt 16. The registration pattern images are arranged along the transport direction (sub-scan direction) D16 in the order of K, C, M, Y at predetermined space intervals (say, 0.5 mm). While the figure shows only a black registration pattern image RP(K), a cyan registration pattern image RP(C), a magenta registration pattern image RP(M), a yellow registration pattern image RP(Y) and a black registration pattern image RP(K), a plural number of registration pattern images are formed for each color.

When the all or some of the registration pattern images are formed in this manner, the photoemitter (not shown) of the test pattern sensor 18 is activated to permit the test pattern sensor 18 to detect the registration pattern images (Step S8) (pattern detection step). Specifically, the registration pattern images RP(K), RP(C), RP(M), RP(Y) formed on the intermediate transfer belt 16 in the aforementioned manner are moved in the transport direction D16 in conjunction with the movement of the intermediate transfer belt 16 so as to pass by the test pattern sensor 18. At this time, the light from the registration pattern images is received by the photodetector (not shown) of the test pattern sensor 18, while the voltage level of the signal outputted from the test pattern sensor 18 fluctuates according to the quantity of received light. Hence, time at which each registration pattern image passes by the test pattern sensor 18 may be determined by measuring the voltage level. Thus is acquired the positional information on the registration pattern images. Based on the positional information thus acquired, a space interval between the registration pattern images may be determined.

Noting that the fluctuations of the voltage level of the output signal vary from one color to another, the embodiment is arranged such that the respective yellow toner threshold TH(Y), magenta toner threshold TH(M), cyan toner threshold TH(C), and black toner threshold TH(K) suited for per-color pattern detection are previously determined and stored in the ROM 23 as the pattern-detection threshold information. Based on the pattern-detection threshold information, the positional information on the registration pattern images is acquired on a per-color basis. For instance, when the registration pattern image RP(K) of the black toner reaches the test pattern sensor 18, the registration pattern image RP(K) is detected by the sensor 18 while the positional information on the registration pattern image RP(K) is acquired by comparing the voltage level of the output signal from the sensor 18 with the toner threshold TH(K), as shown in FIG. 6. The same procedure is taken on the other toner colors. When the positional information pieces with respect to the all registration pattern images are acquired, the color registration offset is corrected based on the positional information pieces so acquired (Step S9) (correction step).

On the other hand, in a case where the detected voltage level is below the base detection threshold TH(BT), as indicated by a broken line in FIG. 5, for example, or where the quantity of light received by the sensor 18 is decreased because of a contaminated base of the pattern formation region $R_p$ ("NO" in Step S4), it is determined that the pattern formation region $R_p$ has an improper surface condition. The photoemitter of the test pattern sensor 18 is turned off and the acquisition of the surface condition of the intermediate transfer belt 16 is terminated (Step S10). Subsequently, the intermediate transfer belt 16 is brought to rest at an initial position, whereas the predetermined time period (Pstart) is changed based on the following equation (Step S11):

$$Pstart=Pstart+haba.$$

Thus, the pattern formation region $R_p$ is shifted by a distance equivalent to the length of time (haba) with respect to the transport direction D16, or by the length of the pattern formation region. Then, the control flow returns to Step S1 to repeat the acquisition of the surface condition of the intermediate transfer belt 16. Thus, the acquisition of the surface condition of the intermediate transfer belt 16 (Steps S1 to S6), the formation of the registration pattern images (Step S7), the detection thereof (Step S8) and the correction of color registration offset (S9) are performed on an alternative pattern formation region $R_p$.

According to the embodiment as described above, the base information is acquired prior to the formation of the registration pattern images, the base information acquired by detecting the surface of the intermediate transfer belt 16 or particularly the surface of the pattern formation region $R_p$ by means of the test pattern sensor 18. Based on the base information, the surface condition of the formation region $R_p$ is determined, whereas the formation of the registration pattern images is controlled based on the surface condition. After an adequate consideration is given to the surface condition of the pattern formation region $R_p$ on which the registration pattern images are to be formed, the registration pattern images are formed thereon. This permits the positions of the registration pattern images to be detected with high accuracies. As a result, the color registration offset may be corrected properly, thus ensuring that the color registration offset or degraded color tone is positively obviated.

Furthermore, the formation/detection of the registration pattern images and the correction of color registration offset are cancelled if it is determined from the base information that the belt surface condition at the pattern formation region $R_p$ departs from the proper range, the departure resulting from the contamination or damage of the pattern formation region $R_p$ of the intermediate transfer belt 16. Therefore, a wasteful toner consumption or time wasted on the correction of color registration offset may be reduced. In addition, the display unit 54 may also be adapted to display an error message, as required, to inform the user of the improper surface condition.

In the aforementioned case where the formation of the registration pattern images is cancelled, the pattern formation region $R_p$ is re-defined and the registration pattern images are formed afresh on an alternative pattern formation region $R_p$. Since the formation/detection of the registration pattern images and the correction of color registration offset are performed using the pattern formation region $R_p$ thus changed, the correction of color registration offset may be enhanced in effectiveness.

According to the above embodiment, the respective yellow toner threshold TH(Y), magenta toner threshold TH(M), cyan toner threshold TH(C), and black toner threshold TH(K) suited for per-color pattern detection are previously determined and are used as the pattern-detection threshold information for acquiring the positional information related to the registration pattern images. Therefore, the positional information piece with respect to the registration pattern image of each color may be acquired based on the optimum pattern-detection threshold information even when the voltage level of the output signal from the test pattern sensor 18 varies from one toner color to another, as shown in FIG. 6.

Second Embodiment

Figure 7:
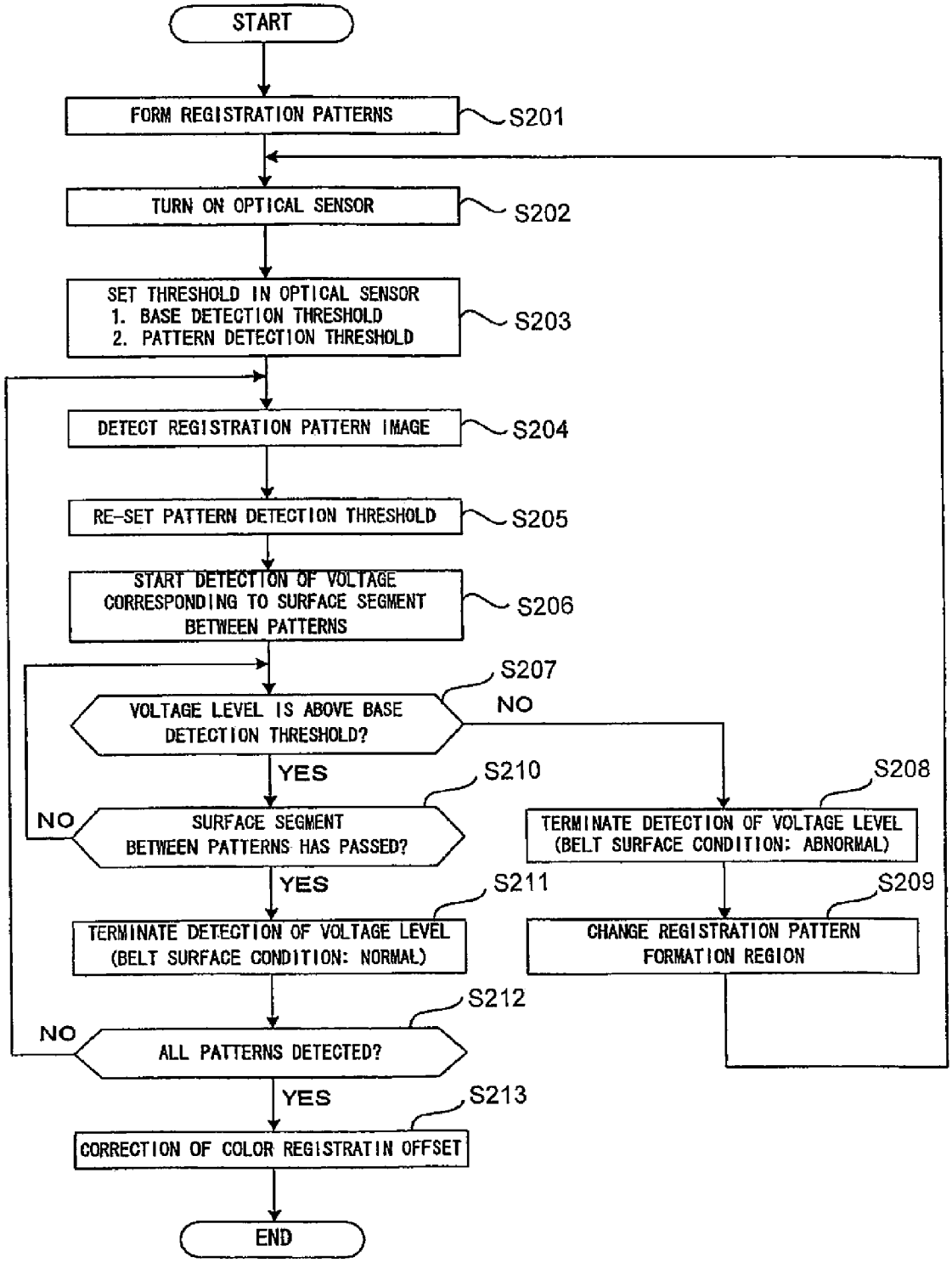
FIG. 7 is a flow chart showing operations according to a second embodiment of the image forming apparatus of FIG. 1.
Figure 8:
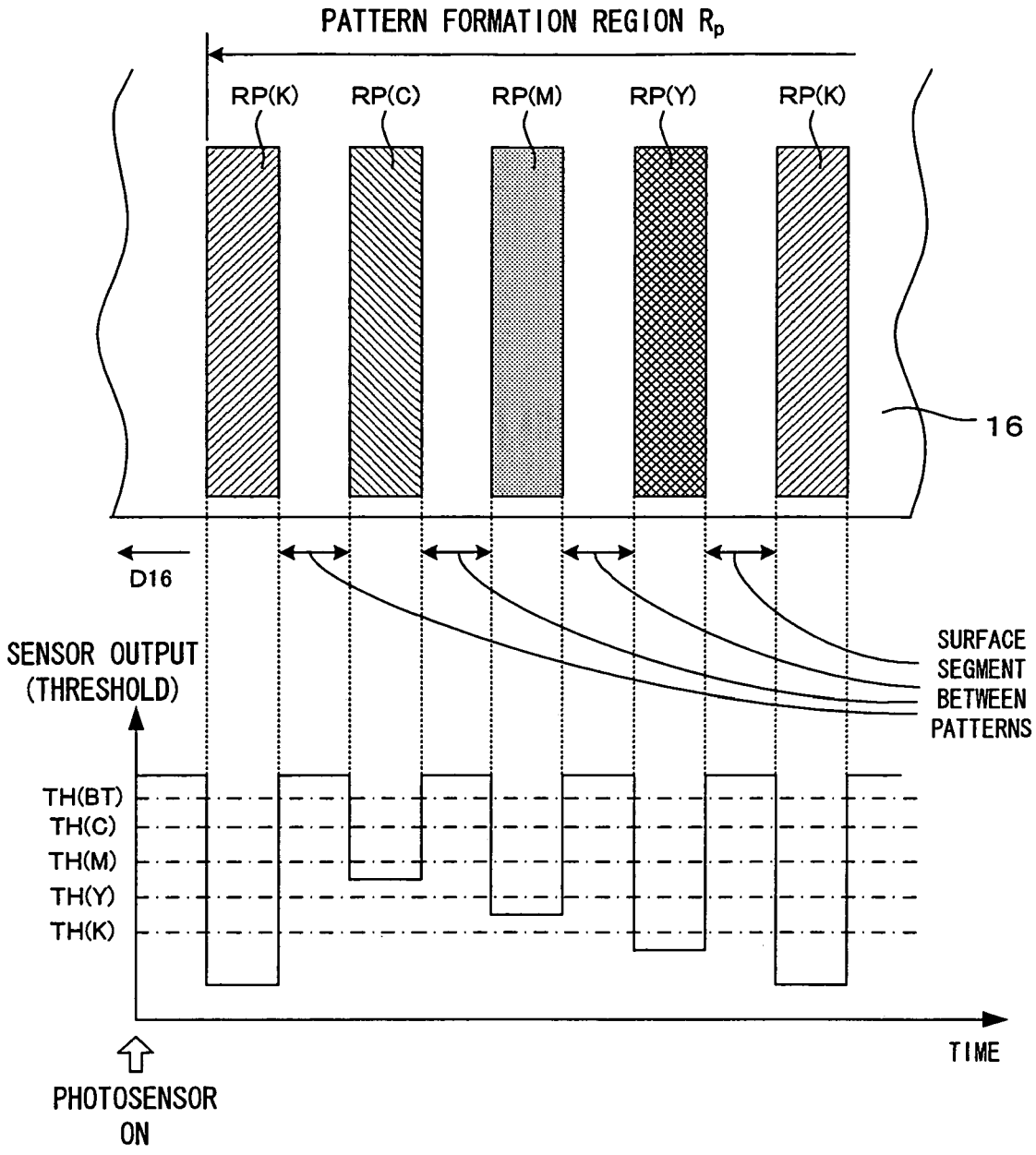
FIG. 8 is a schematic diagram showing a pattern detection operation for the correction of color registration offset.

FIG. 7 is a flow chart showing operations according to a second embodiment of the image forming apparatus of FIG. 1. The chart illustrates the formation/detection of the registration pattern images and the correction of color registration offset. FIG. 8 is a schematic diagram showing a pattern detection operation for the correction of color registration offset. In this apparatus, the correction of color registration offset using the registration pattern images is performed at a proper time such as when the apparatus is turned on or when the cartridge is replaced. More specifically, the CPU 521 of the engine controller 52 functions as the "surface condition acquisition unit" and a "correction control unit" of the invention according to a program related to the correction of color registration offset and stored in the ROM 523. The CPU 521 controls the individual parts of the apparatus in the following manner for executing the formation/detection of the registration pattern images and the correction of color registration offset. With reference to FIG. 7 and FIG. 8, the formation/detection of the registration pattern images and the correction of color registration offset will be described as below.

The image forming stations Y, M, C, K form the registration pattern images based on the control command from the CPU 521 of the engine controller 52. The resultant images are transferred to the intermediate transfer belt 16 so that the registration pattern images are formed on a part (pattern formation region) of the surface of the intermediate transfer belt 16 (Step S201) (pattern formation step). It is noted here that the shape, dimensions, spacing, arrangement and number of the registration pattern images are optional and a large number of various modes have conventionally been proposed. According to the embodiment, as shown in FIG. 8 for example, the registration pattern images having a band-like shape (0.5 mm in width, for example) and extending in parallel with the direction (main scan direction) orthogonal to the transport direction D16 of the intermediate transfer belt 16 are formed on a part of the surface of the intermediate transfer belt 16. The registration pattern images are arranged along the transport direction (sub-scan direction) in the order of K, C, M, Y at predetermined space intervals (say, 0.5 mm). While the figure shows only a black registration pattern image RP(K), a cyan registration pattern image RP(C), a magenta registration pattern image RP(M), a yellow registration pattern image RP(Y) and a black registration pattern image RP(K), a plural number of registration pattern images are formed for each color. The surface of the intermediate transfer belt 16 is exposed at space between a respective pair of adjoining registration pattern images.

When the all or some of the registration pattern images are formed in this manner, the photoemitter (not shown) of the test pattern sensor 18 is activated to permit the test pattern sensor 18 to detect the registration pattern images (Step S202). Specifically, the registration pattern images RP(K), RP(C), RP(M), RP(Y) formed on the intermediate transfer belt 16 in the aforementioned manner are moved in the transport direction D16 in conjunction with the movement of the intermediate transfer belt 16 so as to pass by the test pattern sensor 18. At this time, the light from the registration pattern images is received by the photodetector (not shown) of the test pattern sensor 18, while the voltage level of the signal outputted from the test pattern sensor 18 fluctuates according to the quantity of received light. Hence, time at which each registration pattern image passes by the test pattern sensor 18 may be determined by measuring the voltage level. Thus is acquired the positional information related to the registration pattern images. Based on the positional information thus acquired, a space interval between the registration pattern images may be determined. Furthermore, when a pattern-formation region segment of the intermediate transfer belt 16, the segment located between a respective pair of adjoining registration pattern images, passes by the test pattern sensor 18, the test pattern sensor 18 outputs a signal at a voltage level corresponding to a surface condition of the region segment. In a case where the pattern formation region is substantially in an initial condition, the voltage level of the sensor output remains at an initial value. In a case where the pattern formation region sustains contamination, on the other hand, the voltage level of the sensor output fluctuates from the initial value. Thus, the embodiment is adapted to acquire the surface condition of the pattern formation region by detecting the voltage of the sensor output corresponding to the surface segment of the intermediate transfer belt 16, which segment is located between a respective pair of adjoining registration pattern images.

Noting that the fluctuations of the voltage level of the output signal vary from one color to another, the embodiment is arranged such that the respective yellow toner threshold TH(Y), magenta toner threshold TH(M), cyan toner threshold TH(C), and black toner threshold TH(K) suited for per-color pattern detection are previously determined and stored in the ROM 23 as the pattern-detection threshold information. In the subsequent Step S203 (pattern detection step), the threshold TH(K) for the black toner as a reference color is set as the pattern-detection threshold information. Since the voltage level of the output signal also fluctuates according to the surface condition of the pattern formation region, the base detection threshold TH(BT) is retrieved from the memory space segment 523B of the ROM 523 and is set as the base-detection threshold information.

When the black registration pattern image RP(K), as the first image, arrives at the test pattern sensor 18, the sensor 18 detects the registration pattern image RP(K) (Step S204). Specifically, the positional information piece with respect to the registration pattern image RF(K) is acquired by comparing the voltage level of the output signal from the sensor 18 with the toner threshold TH(K), as shown in FIG. 8.

When the registration pattern image RP(K) has passed by the sensor 18, the pattern detection threshold information is set for the succeeding toner color (Step S205). At this time, the surface segment of the intermediate transfer belt 16, the segment located between the registration pattern image RP(K) and the registration pattern image RP(C), arrives at the sensor 18, so that the voltage level of the output signal from the sensor 18 reflects the surface condition of the pattern-formation region segment free from the registration pattern image. Hence, the detection of the voltage level of the output signal from the sensor is started (Step S206) for acquiring the surface condition of the pattern formation region (Step S207) (surface condition acquisition step). In Step S207, determination is made as to whether the voltage level corresponding to the surface segment between the patterns is above the base detection threshold TH(BT) or not, as shown in FIG. 8. In a case where the voltage level is below the base detection threshold TH(BT) or where the quantity of light received by the sensor 18 is decreased due to the contamination of the base segment between the patterns ("NO" in Step S207), it is determined that the intermediate transfer belt 16 is in an abnormal surface condition, while the detection of the voltage level is immediately terminated (Step S208). In addition, the formation of the registration pattern images by the respective image forming stations Y, M, C, K is temporarily suspended, as well. Subsequently, the image forming stations Y, M, C, K restart operating to form the registration pattern images on place different from the above pattern formation region (an alternative pattern formation region) (Step S209). Then, the control flow returns to Step S202 to detect the registration pattern images formed afresh.

On the other hand, if it is determined in Step S207 that the voltage level is above the base detection threshold TH(BT), indicating that the base condition of the surface segment between the patterns falls within the predetermined proper range and does not adversely affect the detection of the registration pattern images, the CPU waits for the surface segment between the patterns to pass by the sensor 18 in Step S210 and then, terminates the detection of the voltage level (Step S211 . Subsequently, determination is made as to whether the positions of all the registration pattern images are detected or not (Step S212). Unless the detection of the positions of all the registration pattern images is done, the control flow returns to Step S204 to carry out the series of operations including the acquisition of the positional information on the registration pattern image and the detection of the abnormality of the base segment between the patterns. When the positional information pieces with respect to all the registration pattern images are acquired, the correction of color registration offset is performed based on these positional information pieces (Step S213) (correction step).

According to the embodiment as described above, the test pattern sensor (optical sensor) 18 not only detects the plural registration pattern images RP(K), RP(C), RP(M), RP(Y) formed on the intermediate transfer belt 16, but also detects the surface segment of the intermediate transfer belt 16, the segment located between the respective pair of adjoining registration pattern images, thereby acquiring the base information on the pattern formation region (based on whether the voltage level corresponding to the surface segment between the patterns is above the base detection threshold TH(BT) or not). The base information thus acquired is used for verifying that the intermediate transfer belt 16 does not sustain contamination or damage at the pattern formation region and the belt surface condition at the region falls within the proper range. After the verification, the formation/detection of the registration pattern images is carried on and followed by the correction of color registration offset. Therefore, the correction of color registration offset may be enhanced in reliability, so that the occurrence of color registration offset or degraded color tone is assuredly prevented.

On the other hand, the formation of registration pattern images and the correction of color registration offset are cancelled if it is determined from the base information that the surface condition of the pattern formation region of the intermediate transfer belt 16 depart from the proper range, as a result of the contamination or damage of the pattern formation region of the belt. Therefore, the wasteful toner consumption or the time wasted on the correction of color registration offset may be reduced. In addition, the display unit 54 may also be adapted to display the error message, as required, to inform the user of the improper surface condition.

Since the base information on the pattern formation region is acquired in the intervals between the detections of the registration pattern images, an extra time is not used for the acquisition of the base information so that time loss may be obviated.

Furthermore, the arrangement is made such that when the correction of color registration offset is cancelled, the registration pattern images are formed afresh on another surface region of the intermediate transfer belt 16 than the surface region with the registration pattern images previously formed thereon and then, the correction of the color registration offset is performed. This affords the following effect. That is, the re-defined surface region (the alternative pattern formation region) may be used for carrying out the formation/detection of the registration pattern images and the correction of color registration offset, so that the effectiveness of the correction of color registration offset may be enhanced. It is noted here that a region selected as the "alternative pattern formation region" may be shifted away from the original pattern formation region in the sub-scan direction or in the main scan direction.

According to the above embodiment, the respective yellow toner threshold TH(Y), magenta toner threshold TH(M), cyan toner threshold TH(C), and black toner threshold TH(K) suited for per-color pattern detection are previously determined and are used as the pattern-detection threshold information for acquiring the positional information related to the registration pattern images. Therefore, the positional information piece with respect to the registration pattern image of each color may be acquired based on the optimum pattern-detection threshold information even when the voltage level of the output signal from the sensor 18 varies from one toner color to another, as shown in FIG. 8.

Third Embodiment

Figure 9:
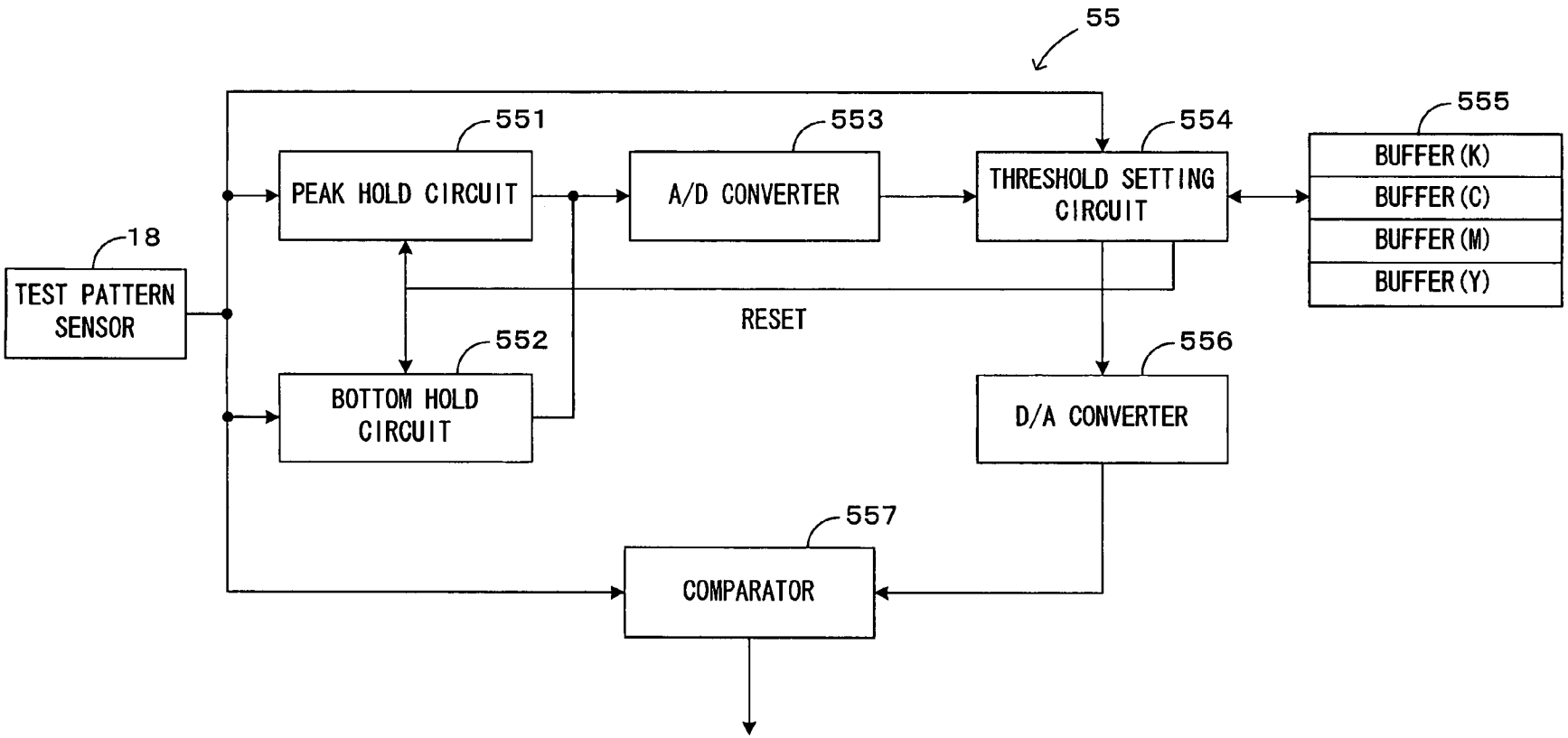
FIG. 9 is a diagram showing an image forming apparatus according to the third embodiment of the invention.
Figure 10:
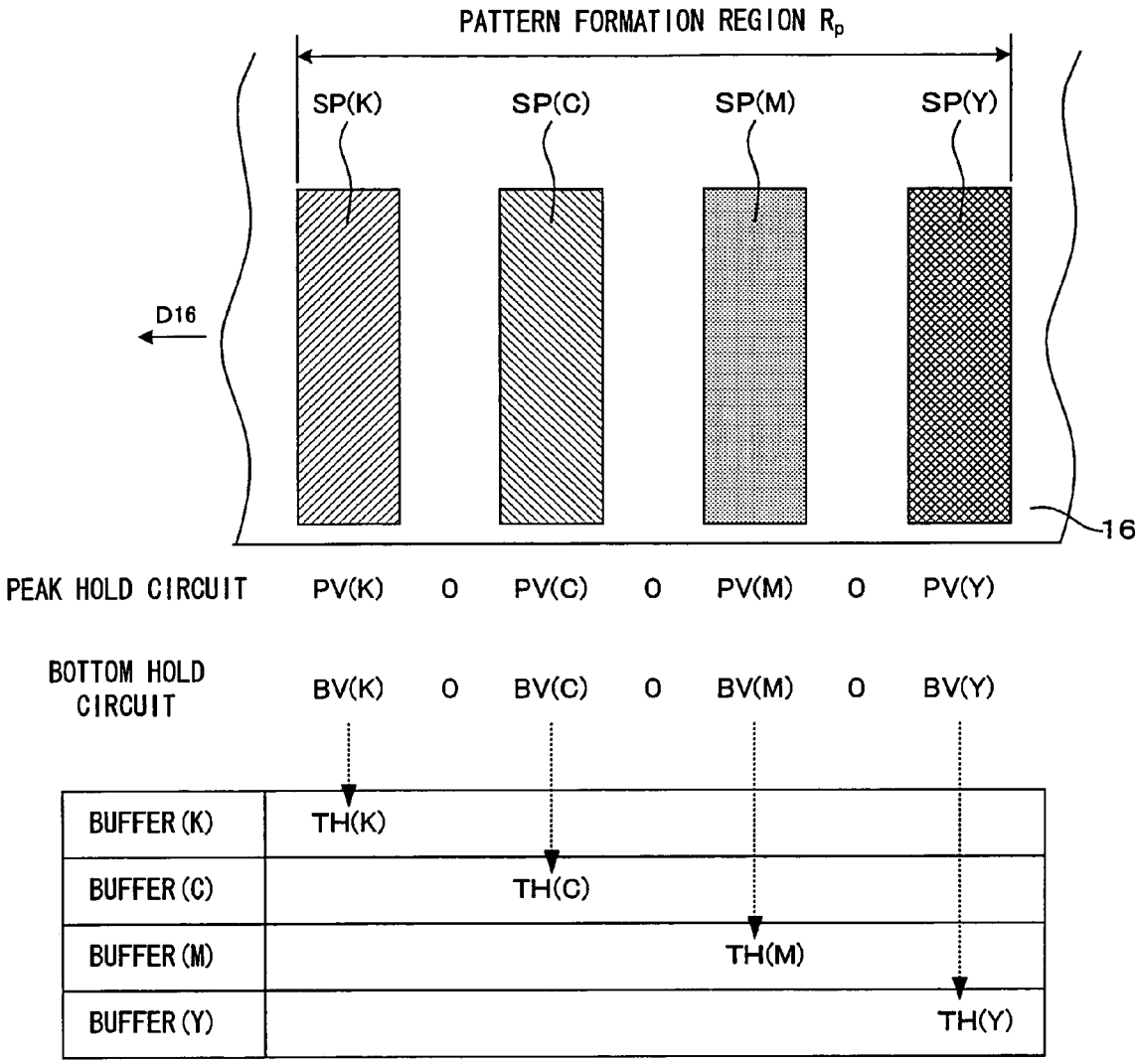
FIG. 10 is a schematic diagram showing an operation of the detection processor circuit of FIG. 9.

In the foregoing embodiments, these pieces of pattern-detection threshold information are previously acquired and stored in the ROM 523. However, an alternative arrangement may be made wherein threshold setting pattern images (hereinafter, simply referred to as "sample patterns") are formed as follows for acquiring the pattern-detection threshold information pieces on the respective colors. Referring to FIG. 9 and FIG. 10, a third embodiment of the invention will be described as below.

FIG. 9 is a diagram showing an image forming apparatus according to the third embodiment of the invention. The embodiment is characterized in that the sample patterns of the individual colors are formed prior to the formation of the registration pattern images and that a detection processor circuit 55 is added which updates the pattern-detection threshold information pieces on the individual colors based on the detection results of the sample patterns and stores the resultant information pieces. Except for this, this embodiment has the same basic constitution as that of the embodiment of FIG. 1. Therefore, like components are represented by the same or equivalent reference characters, respectively, the explanation of which is dispensed with.

As shown in the figure, the detection processor circuit 55 has a peak hold circuit 551 and a bottom hold circuit 552 connected to the photodetector of the test pattern sensor 18. The peak hold circuit 551 and the bottom hold circuit 552 detect a maximum value and a minimum value of the voltage level of the output signal from the photodetector, respectively. The maximum value and the minimum value are converted into digital values by an A/D converter 553. Subsequently, the resultant digital values are inputted to a threshold setting circuit 554, which defines pattern-detection threshold information based on the maximum value and minimum value of the voltage level. For instance, the threshold setting circuit 554 writes a mean value of these maximum and minimum values, as the pattern-detection threshold information, to a buffer 555. After defining the pattern-detection threshold information, the threshold setting circuit 554 applies a reset signal to the peak hold circuit 551 and the bottom hold circuit 552 for clearing the values held by the respective circuits. In the execution of the detection of the position of the registration pattern image, the threshold setting circuit 554 retrieves from the buffer 555 the pattern-detection threshold information piece corresponding to the toner color of the registration pattern image. The retrieved information piece is inputted to a comparator 557 via a D/A converter 556. The comparator 557, in turn, compares the voltage level of the output signal from the test pattern sensor 18 with the pattern-detection threshold information piece and outputs a comparison result, as a pattern detection signal, to the CPU 521.

FIG. 10 is a schematic diagram showing an operation of the detection processor circuit of FIG. 9. When the pattern-detection threshold information is updated and stored by the detection processor circuit 55 of the above configuration, the sample patterns of the individual colors are formed on the intermediate transfer belt 16 in the same way as the registration pattern images are formed. Specifically, the imager forming stations Y, M, C, K individually form the sample patterns according to control commands from the CPU 521 of the engine controller 52, while the sample patterns are transferred to the intermediate transfer belt 16 so as to form sample patterns SP(K), SP(C), SP(M), SP(Y) in the respective colors on a part (pattern formation region $R_p$) of the surface of the intermediate transfer belt 16. As shown in the figure, the sample patterns are arranged along the transport direction (sub-scan direction) at predetermined space intervals. The shape, dimensions, spacing, arrangement and number of the sample patterns SP(K), SP(C), SP(M), SP(Y) are also optional.

When the sample patterns SP(K), SP(C), SP(M), SP(Y) are formed in this manner, the photoemitter (not shown) of the test pattern sensor 18 is activated to permit the test pattern sensor 18 to detect the sample patterns SP(K), SP(C), SP(M), SP(Y). When the sample patterns SP(K), SP(C), SP(M), SP(Y) formed on the intermediate transfer belt 16 are moved in the transport direction D16 in conjunction with the movement of the intermediate transfer belt 16 and are passed by the test pattern sensor 18, the pattern-detection threshold information pieces on the respective colors are acquired and re-stored in the buffer 555. Since essentially the same operation is performed to acquire the information piece on each of the toner colors, the description is made exclusively on the acquisition of the information piece on the black color.

While the black sample pattern SP(K) is passing by the test pattern sensor 18, a maximum value PV(K) and a minimum value BV(K) of the voltage level of the output signal from the photodetector of the sensor 18 are detected by the peak hold circuit 551 and the bottom hold circuit 552, respectively. Based on the maximum value PV(K) and the minimum value BV(K) thus detected, the threshold setting circuit 554 defines the latest black toner threshold TH(K) and writes the latest value to a buffer (K) in the buffer 555. Thus, the existing pattern-detection threshold information piece on the black color is updated. At completion of the update to the pattern-detection threshold information piece on the black color, the peak hold circuit 551 and the bottom hold circuit 552 are reset. The same procedure as that for the black toner threshold is taken to define the latest toner thresholds TH(C), TH(M), TH(Y) and to update the pattern-detection threshold information pieces in the buffer 555.

According to the embodiment as described above, the sample patterns SP(K), SP(C), SP(M), SP(Y) are formed in the respective colors, whereas the latest toner thresholds TH(K), TH(C), TH(M), TH(Y) are defined as the pattern-detection threshold information pieces based on the sample patterns thus formed. This provides for the detection of accurate positional information pieces with respect to the registration pattern images, so that the color registration offset may be corrected with higher accuracies. The pieces of pattern-detection threshold information may be updated based on the sample patterns at any time. However, the update to the information may preferably be made invariably prior to the formation of the registration pattern images because the positional information related to the registration pattern images may always be acquired using the latest pattern-detection threshold information.

In this embodiment, the toner thresholds TH(K), TH(C), TH(M), TH(Y) are defined simply by detecting the sample patterns by means of the sensor 18. However, the surface condition of the pattern formation region $R_p$ may potentially affect the voltage level of the output signal from the sensor 18 during the detection of the sample patterns. Just as in the foregoing embodiments, therefore, the surface condition of the intermediate transfer belt 16 or particularly that of the pattern formation region $R_p$ may be acquired by means of the test pattern sensor 18 prior to the formation of the sample patterns, and the formation of the sample patterns may be controlled based on the surface condition thus acquired. Thus, the sample patterns may be formed with the adequate consideration given to the surface condition of the pattern formation region $R_p$ where the sample patterns are to be formed. Accordingly, the positions of the sample patterns may be detected with high accuracies. As a result, the pattern-detection threshold information may be increased in reliability. Furthermore, if it is determined from the base information that the belt surface condition at the pattern formation region $R_p$ of the intermediate transfer belt 16 departs from the proper range as the result of the contamination or damage thereof, the formation of the sample patterns and the acquisition of the pattern-detection threshold information are cancelled so as to reduce the wasteful consumption of the toner. In addition, the sample patterns may be formed on an alternative pattern formation region $R_p$ such as to define the latest pattern-detection threshold information.

In this embodiment, the toner thresholds TH(K), TH(C), TH(M), TH(Y) are defined simply by detecting the sample patterns by means of the sensor 18. However, the surface condition of the pattern formation region may potentially affect the voltage level of the output signal from the sensor 18 during the detection of the sample patterns. Just as in the foregoing embodiments, therefore, the surface segment of the intermediate transfer belt, the segment located between a respective pair of adjoining sample patterns, may be detected in parallel with the detection of the sample patterns. In this manner, the base information on the pattern formation region (indicative of whether the voltage level corresponding to the surface segment between the patterns is above the base detection threshold TH(BT) or not) may be acquired. The base information may be used for verifying that the pattern formation region of the intermediate transfer belt 16 does not sustain contamination or damage and the belt surface condition at the region falls within the proper range. After the verification, the formation/detection of the sample patterns may be carried on and followed by the definition of the pattern-detection threshold information. Thus, the reliability of the pattern-detection threshold information may be enhanced. If it is determined from the base information that the belt surface condition at the pattern formation region of the intermediate transfer belt 16 departs from the proper range as the result of the contamination or damage thereof, the formation of the sample patterns and the acquisition of the pattern-detection threshold information are cancelled so as to reduce the wasteful consumption of the toner. In addition, the sample patterns may be formed on an alternative pattern formation region so as to define the latest pattern-detection threshold information.

Fourth Embodiment

In the foregoing embodiments, prior to the formation of the registration pattern images or the sample patterns on the pattern formation region $R_p$, the surface condition of only the pattern formation region $R_p$ is acquired for verifying that the surface condition of the pattern formation region $R_p$ falls within the proper range. Alternatively, however, the base information on the overall circumference of the intermediate transfer belt 16 with respect to the transport direction D16 may be acquired, whereas the pattern formation region may be defined based on the base information thus acquired and the registration pattern images or the sample patterns may be formed on the pattern formation region thus defined. A specific description will be made as below with reference to FIG. 11.

Figure 11:
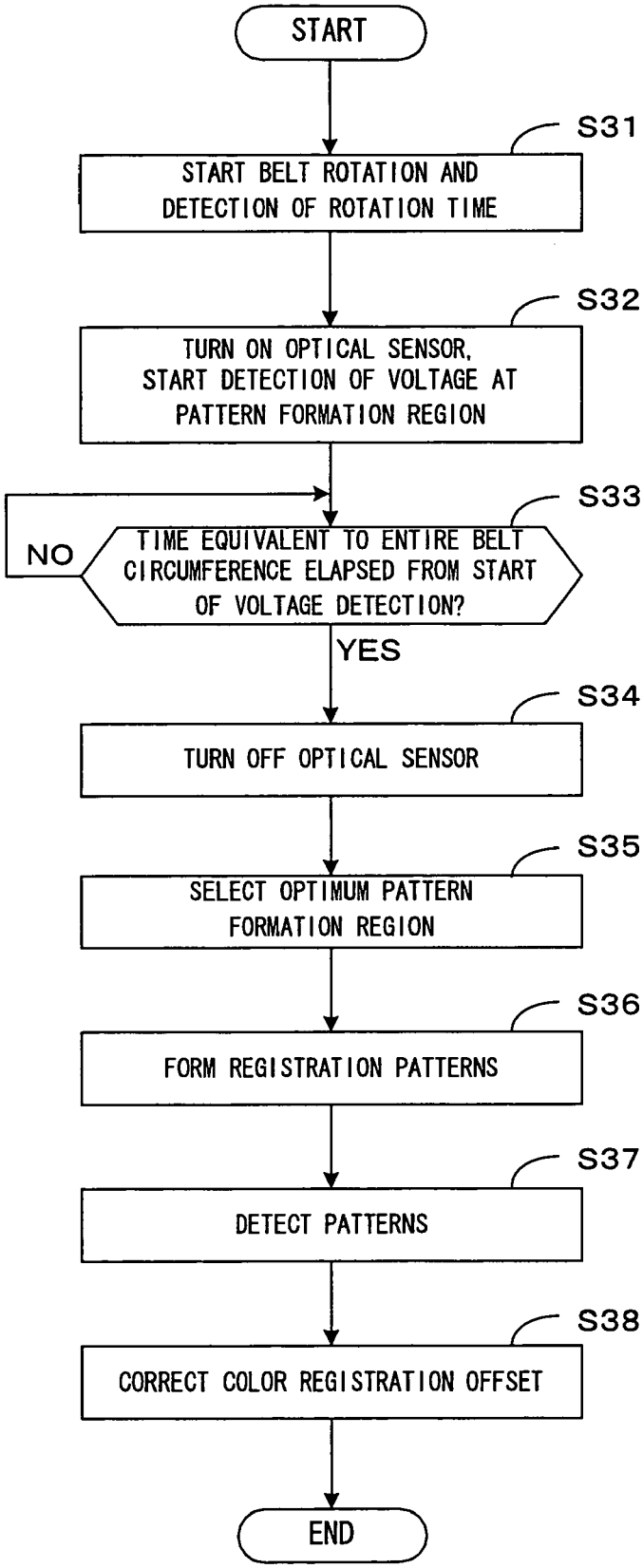
FIG. 11 is flow chart showing operations of the image forming apparatus according to forth embodiment of the invention.

FIG. 11 is flow chart showing operations of the image forming apparatus according to forth embodiment of the invention. In this embodiment, the drive motor (not shown) starts to rotate the drive roller 14 for driving the intermediate transfer belt 16 into the cycling motion in the direction of the arrow D16 in Step S31 prior to the formation/detection of the registration pattern images and the correction of color registration offset. In addition, the detection is started to determine the rotation time of the intermediate transfer belt 16 from the start of the rotation thereof, so as to calculate the moving distance of the intermediate transfer belt 16.

In synchronism with or immediately after the start of rotation, the photoemitter (not shown) of the test pattern sensor 18 is activated to permit the test pattern sensor 18 to start detecting the surface condition of the intermediate transfer belt 16 (Step S32). Thus, the surface of the intermediate transfer belt 16 passes by the test pattern sensor 18 in conjunction with the movement of the intermediate transfer belt 16 in the transport direction D16, while the light reflected from the surface is received by the photodetector (not shown) of the test pattern sensor 18. The voltage level of the signal outputted from the test pattern sensor 18 fluctuates according to the quantity of received light. Hence, the surface condition of the intermediate transfer belt 16 may be acquired as the base information by detecting the voltage level.

The acquisition of the base information is accomplished by carrying out such detection until a length of time corresponding to a distance covered by one cycling motion of the intermediate transfer belt 16 has elapsed (Step S33) from the start of detection of the voltage level (Step S32). Thus, the base information on the overall circumference of the intermediate transfer belt 16 may be acquired. In the subsequent Step S34, the photoemitter of the test pattern sensor 18 is turned off to terminate the acquisition of the surface condition of the intermediate transfer belt 16. Based on the surface condition thus acquired, a surface region suited for the formation of the registration pattern images is selected from the surface of the intermediate transfer belt 16, and is defined as the pattern formation region. That is, the surface region of the intermediate transfer belt 16, which has the surface condition falling within the proper range, is determined based on the base information and defined as the pattern formation region (Step S35).

This process is followed by the formation of the registration pattern images (Step S36), the detection thereof (Step S37) and the correction of color registration offset (Step S38) which are performed in the same way as in the foregoing embodiments.

According to the embodiment as described above, the base information on the overall circumference of the intermediate transfer belt 16 with respect to the transport direction (moving direction) D16 is acquired, whereas the pattern formation region is selected based on the base information.

Hence, a proper definition of the pattern formation region may be accomplished. Since the registration pattern images are formed on the pattern formation region thus defined, the positions of the registration pattern images may be detected with high accuracies. As a result, a proper correction of color registration offset may be accomplished.

It is to be noted that the invention is not limited to the foregoing embodiments and various changes and modifications other than the above may be made thereto so long as such changes and modifications do not deviate from the scope of the invention. While the foregoing embodiments apply the invention to the image forming apparatus, for example, wherein the registration pattern images are formed on the intermediate transfer belt 16, the applicability of the invention is not limited to this. The invention is applicable to all types of apparatuses designed to form the registration pattern images on the transfer medium such as an intermediate transfer drum and a transfer sheet and to perform the correction of color registration offset.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus wherein a plurality of image forming stations are arranged along a moving direction of a transfer medium and form toner images having different colors from each other, an optical sensor detects the toner images which are formed as registration patterns on a surface of the transfer medium at space intervals along the moving direction and outputs a signal, and correction of color registration offset is performed by correcting the registration offset between/among the plural colors based on the output signal from the optical sensor which detects the registration pattern images, the apparatus comprising:

a surface condition acquisition unit which acquires a surface condition of the transfer medium based on base information acquired by the optical sensor detecting a surface segment of the transfer medium, the surface segment being located between two adjoining registration pattern images, wherein the surface condition is acquired by detecting the surface segment after the registration patterns are formed on the surface of the transfer medium; and a correction control unit which controls the correction of color registration offset based on the surface condition of the transfer medium acquired by the surface condition acquisition unit.

2. An image forming apparatus according to claim 1, wherein the correction of color registration offset is performed in a state where a surface condition of a surface region to form the plural registration pattern images thereon falls within a predetermined proper range, and wherein the correction control unit cancels the correction of color registration offset based on the registration pattern images when the surface condition of the transfer medium acquired by the surface condition acquisition unit departs from the proper range.

3. An image forming apparatus according to claim 2, further comprising a memory for base detection which stores base-detection threshold information corresponding to the proper range, wherein, on the basis of the base-detection threshold information and the base information, the surface condition acquisition unit determines whether the surface condition of the transfer medium departs from the proper range or not, so as to acquire the surface condition of the transfer medium.

4. An image forming apparatus according to claim 2, wherein at the cancellation of the correction of color registration offset, the correction control unit forms afresh the registration pattern images on an alternative surface region of the transfer medium to the surface region where the plural registration pattern images were previously formed.

5. An image forming apparatus according to claim 1, further comprising a memory for pattern detection which stores pattern-detection threshold information pieces, each of which functions as a detection reference for registration pattern image of each toner color, wherein positional information pieces with respect to the registration pattern images formed on the transfer medium are acquired on a per-color basis by comparing the output signal provided by the optical sensor detecting the registration pattern image of each color with each corresponding pattern-detection threshold information piece, and wherein the registration offset between/among the plural colors is corrected based on the positional information pieces related to the plural toner colors.

6. A method of correcting a registration offset generating in an apparatus wherein a plurality of image forming stations are arranged along a moving direction of a transfer medium and form toner images having different colors each other, the method comprising:

a pattern formation step of forming, as registration pattern images, the toner images by means of the plural image forming stations, the registration pattern images arranged on the transfer medium at space intervals along the moving direction;

a pattern detection step of detecting the registration pattern images for acquiring positional information pieces with respect to the registration pattern images;

a correction step of correcting the registration offset between/among the plural colors based on the positional information pieces acquired by the pattern detection step;

a surface condition acquisition step of acquiring a surface condition of the transfer medium based on base information acquired by an optical sensor detecting a surface segment of the transfer medium, which is located between two adjoining registration pattern images, wherein the surface condition acquisition step is performed after the pattern formation step; and a correction control step of controlling the correction of color registration offset based on the surface condition of the transfer medium acquired by the surface condition acquisition step.

* * * * *